US010965066B2

(12) United States Patent
Müller et al.

(10) Patent No.: US 10,965,066 B2
(45) Date of Patent: Mar. 30, 2021

(54) CONNECTOR ARRANGEMENT

(71) Applicant: Rosenberger Hochfrequenztechnik GmbH & Co. KG, Fridolfing (DE)

(72) Inventors: Thomas Müller, Berchtesgaden (DE); Thomas Lödding, Traunstein (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/102,805

(22) Filed: Aug. 14, 2018

(65) Prior Publication Data

US 2019/0058268 A1 Feb. 21, 2019

(30) Foreign Application Priority Data

Aug. 16, 2017 (EP) ..... 17186515

(51) Int. Cl.

| | |
|---|---|
| ***H01R 9/03*** | (2006.01) |
| ***H01R 13/6591*** | (2011.01) |
| ***H01R 13/6474*** | (2011.01) |
| ***H01R 13/6585*** | (2011.01) |
| *H01R 13/6581* | (2011.01) |

(52) U.S. Cl.

CPC ..... *H01R 13/65915* (2020.08); *H01R 9/03* (2013.01); *H01R 13/6474* (2013.01); *H01R 13/6585* (2013.01); *H01R 13/6581* (2013.01)

(58) Field of Classification Search

CPC ..... H01R 9/035; H01R 9/6474

USPC ..... 439/607.41

See application file for complete search history.

(56) References Cited

U.S. PATENT DOCUMENTS 4,634,208 A * 1/1987 Hall ..... H01R 9/032 439/607.51
5,437,563 A * 8/1995 Kihira ..... H01R 13/5219 439/275
5,562,497 A * 10/1996 Yagi ..... H01R 13/516 439/607.47

(Continued)

FOREIGN PATENT DOCUMENTS

DE 102006044479 A1 5/2007
DE 102010039314 A1 2/2012

(Continued)

*Primary Examiner* — Phuong K Dinh

(74) *Attorney, Agent, or Firm* — David P. Dickerson

(57) ABSTRACT

A connector arrangement comprising a connector and a cable connected to the connector, each comprising at least one conductor pair for transmitting a differential signal, wherein the cable comprises a first portion and a second portion, in which the conductor pair comprises electric contacts, and wherein the conductors are at a first mutual distance in the first portion and a second mutual distance in the second portion, the second mutual distance being greater than the first distance, wherein an intermediate portion is formed between the first portion and the second portion, in which intermediate portion the distance between the conductors of a conductor pair increases in the direction of an interface-side end of the connector, wherein the conductor pair is guided in an unshielded cable in the first portion, and wherein the conductors are surrounded by an external conductor in at least one part of the intermediate portion.

11 Claims, 3 Drawing Sheets

(56) References Cited

U.S. PATENT DOCUMENTS

| | | | | |
|---|---|---|---|---|
| 6,616,482 | B2 * | 9/2003 | De La Cruz | H01R 13/6463 439/607.44 |
| 6,805,588 | B2 * | 10/2004 | Yamamoto | H01R 9/035 439/607.41 |
| 7,909,647 | B2 * | 3/2011 | Kawaguchi | H01R 9/035 439/585 |
| 9,130,295 | B2 * | 9/2015 | Nguyen Nhu | H01R 13/447 |
| 2009/0262968 | A1 | 10/2009 | Akino | |
| 2017/0256892 | A1 | 9/2017 | Maesoba et al. | |
| 2019/0058268 | A1 * | 2/2019 | Muller | H01R 9/03 |

FOREIGN PATENT DOCUMENTS

| | | | |
|---|---|---|---|
| DE | 202015000753 | U1 | 3/2015 |
| DE | 112015004078 | T5 | 5/2017 |
| EP | 3021420 | A1 | 5/2016 |

* cited by examiner 200
201
203
205
207
209
211
213

107
109
111
112
113
115
217
219

CONNECTOR ARRANGEMENT

FIELD OF THE INVENTION

The invention relates to a connector arrangement comprising a connector and a cable connected to the connector. The cable guides at least one conductor pair for transmitting a respective differential signal.

TECHNICAL BACKGROUND

DE 202015000753 U1 discloses a connector arrangement comprising a sleeve part. In that case, a core pair for transmitting a differential signal runs in a cable, wherein the cores of the core pair are at a first mutual distance in the interior of the cable. Proceeding from the sheathed cable portion in the direction of the connector the two cores of the core pair diverge in an intermediate portion until they enter a guide section of the connector, in which they are at a second mutual distance, which is greater than the first mutual distance.

On account of the change in distance between the cores, the differential impedance thereof changes, which can result in an interference point.

This is a state in need of improvement.

SUMMARY OF THE INVENTION

In light of this background, the present invention provides a connector arrangement for transmitting differential signals with an improved transmission characteristic.

Loosely speaking, the present disclosure teaches compensating for sudden changes in impedance at the transition from a cable to a connector or in a portion in which the impedance of the connector arrangement changes, for example on account of a change in distance between the conductors of a conductor pair, by means of an external conductor, even though the external conductor has only small effects on the connector arrangement.

In some embodiments, the conductors are twisted in the cable. Twisting/stranding involves fibers or wires being twisted relative to one another and wrapped helically around one another. One application in electrical leads is a twisted-pair cable.

The twisting reduces the mutual influencing of electrical conductors. The twisting reduces differential-mode interference coupled in inductively.

In some embodiments, the external conductor is lengthened at the stripped region in the direction of the cable by way of a sheath. Consequently, the cable can be connected to the connector via the sheath of the cable and respectively the external conductor of the connector. A connection, e.g. crimp connection, between sheath and external conductor only slightly impairs the electrical properties at the transition between cable and connector.

Moreover, with an external conductor that already begins before the intermediate portion, it is possible to compensate for sudden changes in impedance at a different location, for example in the intermediate portion or at the transition from an internal conductor of a cable to internal-conductor electric contacts.

In some embodiments, the external conductor is configured to surround the conductors fully circumferentially. In this way, a sudden change in impedance on account of the intermediate portion, in which the distance between the conductors increases, can be controlled and set particularly simply.

In some embodiments, the external conductor is formed as a paired external conductor. Consequently, the conductors are each guided in a separate external conductor. In this way, the conductors of the conductor pair are decoupled from one another.

In some embodiments, the external conductor comprises a conductive spacer between the conductors, said conductive spacer being configured in particular to determine the course of the conductors.

In some embodiments, an impedance in the first and second portions and also in the intermediate portion is coordinated in each case with respect to the impedance in the other portions by means of the setting of the distance between the conductors and the external conductor and/or by a change in a diameter of the conductors and/or by a change in the distance between the conductors. With these means, the impedance of a connector arrangement can be controlled particularly simply.

In some embodiments, the external conductor is composed of a plurality of parts and the plurality of parts have in particular a non-planar surface profile corresponding to one another. This simplifies the assembly of a connector arrangement and de-couples the conductors from the electromagnetic environment particularly effectively, or the impedance can be set particularly precisely since electromagnetic leaks are reduced.

By way of example, the surface profiles can have a jagged profile, in particular in the shape of a W or V, which in each case form a negative with respect to one another.

In some embodiments, the conductor screen can be formed in an integral fashion and comprise bushings in which a respective conductor is received. This embodiment is particularly robust and can ensure the mutual coupling of the conductors even under vibration influences or other mechanical loads.

It goes without saying that the features mentioned above and those yet to be explained below can be used not only in the combination respectively indicated, but also in other combinations or by themselves, without departing from the scope of the present invention.

The above configurations and developments can be combined, if practical, arbitrarily with one another. Further possible configurations, developments and implementations of the invention also encompass combinations—not explicitly mentioned—of features of the invention described above or below with regard to the exemplary embodiments. In particular, here the person skilled in the art will also add individual aspects as improvements or supplementations to the respective basic form of the present invention.

BRIEF DESCRIPTION OF THE DRAWINGS

The present invention is explained in greater detail below on the basis of the exemplary embodiments indicated in the schematic figures of the drawing, in which here.

The accompanying figures are intended to convey a further understanding of the embodiments of the invention. They illustrate embodiments and in association with the description serve to clarify principles and concepts of the invention. Other embodiments and many of the advantages mentioned are evident in view of the drawings. The elements of the drawings are not necessarily shown in a manner true to scale with respect to one another.

In the figures, identical, functionally identical and identically acting elements, features and components—unless explained otherwise—are provided in each case with the same reference signs.

An interrelated and overarching description of the figures is given below.

DESCRIPTION OF EXEMPLARY EMBODIMENTS

Figure 1:
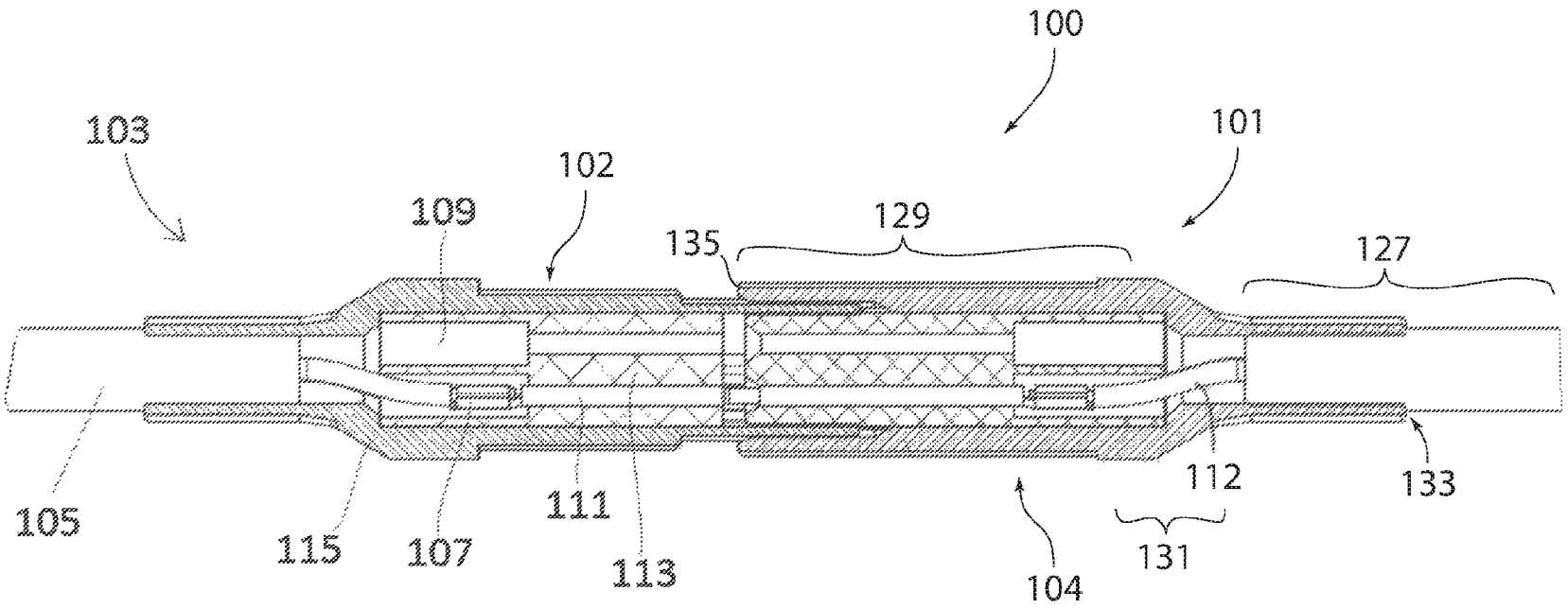
FIG. 1 shows a schematic longitudinal sectional view of one embodiment of a connector assembly according to the present disclosure.

FIG. 1 shows a connector assembly 100 comprising connector arrangements 101 and 103 according to the present disclosure. The connector arrangements 101 and 103 each comprise a cable 105 and a connector 102 or a mating connector 104.

The cable 105 comprises a conductor pair 112 having cores 217. The cores 217 of the conductor pair 112 may be designated as a first conductor and a second conductor, respectively. The cores 217 of the conductor pair 112 are insulated from one another by an insulating sheath. Furthermore, the cable 105 comprises an outer sheath of plastic, which protects the cores 217 and the cable 105 against external influences. The cable 105 has, in an end region, a region 133 in which the cable 105 is connected to the connector 102 or respectively 104.

The cores 217 of the conductor pair 112 of the cable 105 are crimped with the electric contacts 111 of the connectors 102 and respectively 104 by means of a B-crimp 107.

The electric contacts 111 are at a greater distance from one another than the cores 217 of the conductor pair 112. Accordingly, the cores 217 of the conductor pair 112 of the cable 105 in a first portion 127 are at a distance that is less than the distance between the electric contacts 111 in the second portion 129. Accordingly, an intermediate portion 131 is formed between the B-crimp 107 and the first portion 127, in which intermediate portion 131 the distance between the cores 217 of the conductor pair 112 increases to the distance between the electric contacts 111.

The electric contacts 111 are electrically insulated from one another by an insulating part 113. An external conductor 115 is formed concentrically with respect to the insulating part 113, said external conductor simultaneously forming a casing of the connector 102 or respectively 104. Consequently, a signal in the connector is locally screened from external electromagnetic influences. As such, external conductor 115 may be designated as an electrically conductive shield. Similarly, external conductor 115 of connector 102 may be designated as a first electrically conductive shield and external conductor 115 of mating connector 104 may be designated as a second electrically conductive shield. As depicted in the Figures, external conductor 115 may comprise/define an elongate cavity that may be designated as a lumen.

However, the cable 105 does not comprise a screen or external conductor, and so an electrical signal in the cable 105 may possibly be subject to electromagnetic interference that occurs. The external conductor 115 is configured to at least partly compensate for a change in the impedance on account of the change in distance between the cores of the conductor pair 112 and the electric contacts 111. In this regard, the external conductor 115 is adapted with respect to another region in which the external conductor 115 of the connector 102 or respectively 104 extends on the cable 105, with respect to the distance from the external conductor 115 to the conductor pair 112 or respectively to the electric contacts 111. In order to further compensate for a possible sudden change in impedance of the connector arrangement 103 or respectively 101, provision can be made for the external conductor 115 to have further sudden changes in diameter at an inner surface.

The connector assembly 100 comprises a connector 102 and a mating connector 104. A first contact 111 of connector 102 may be plugably engageable with a first counterpart contact 111 of mating connector 104. A second contact 111 of connector 102 may be plugably engageable with a second counterpart contact 111 of mating connector 104.

The connector assembly 100 may connect a first cable 105 via connector 102 and mating connector 104 to a second cable. The cores 217 of conductor pair 112 of first cable 105 may be designated as a first conductor and a second conductor, respectively, and the cores of a conductor pair 112 of the second cable may be designated as a third conductor and a fourth conductor, respectively. Similarly, the corresponding contacts 111 of connector 102 may be designated as a first contact and a second contact, respectively, and the corresponding contacts 111 of mating connector 104 may be designated as a third contact and a fourth contact, respectively.

Figure 2:
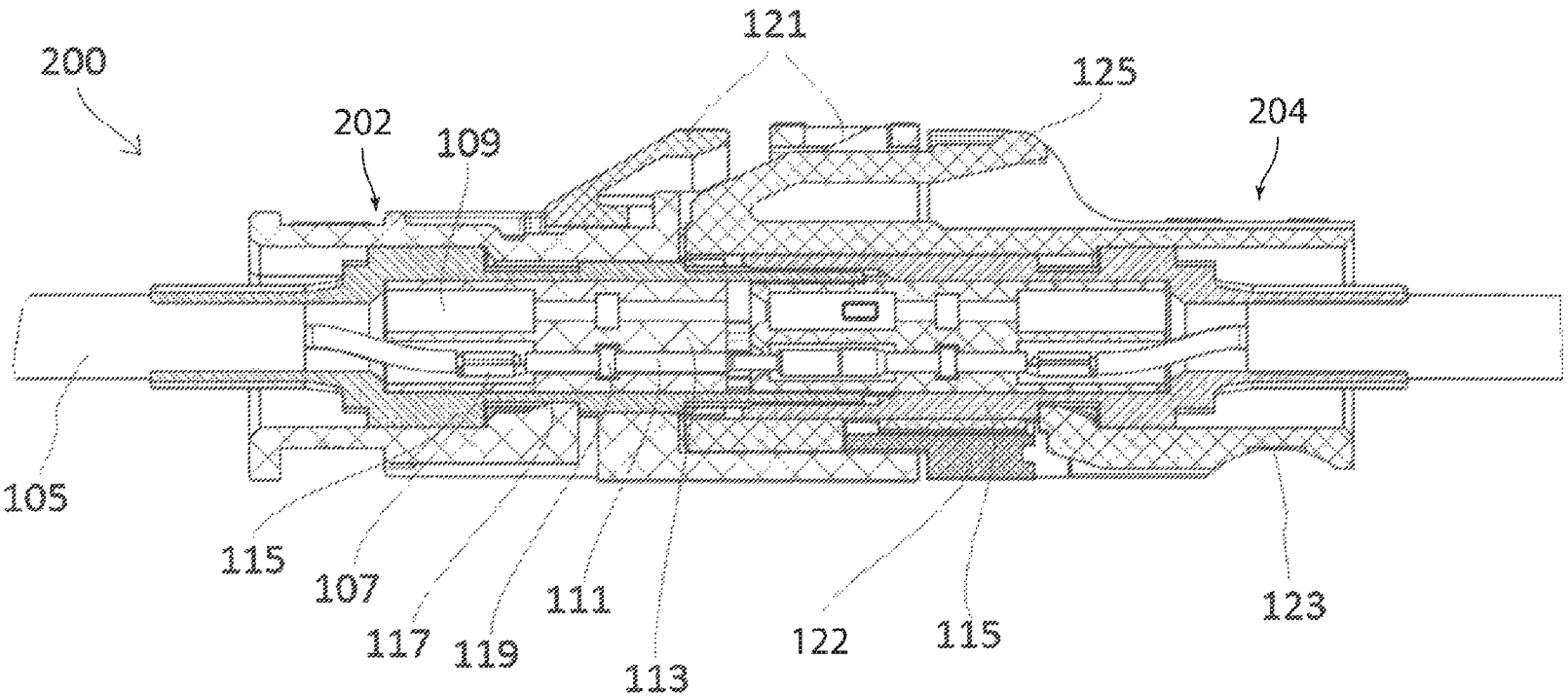
FIG. 2 shows a schematic longitudinal sectional view of one embodiment of a connector assembly according to the present disclosure.

FIG. 2 shows a further connector assembly 200 according to the present disclosure comprising a connector 202 and comprising a mating connector 204. The connector 202 and the mating connector 204 in accordance with FIG. 2 comprise a separate housing 125. A latching groove 117 is formed between the external conductor 115 of the connector 202 and the housing 125, by means of which latching groove the housing 125 latches to the external conductor 115.

The electric contacts 111 each comprise a holding collar 119 in order to secure the electric contacts 111 against slipping in the insulating part 113 of the connector 202. The housing 125 of the connector 202 or respectively of the mating connector 204 comprises an additional latching arrangement 121, by means of which the connector 202 latches to the mating connector 204.

The mating connector 204 comprises a latching arrangement, by means of which the external conductor 115 latches to the housing 125.

In order to release the connector assembly 200 a handle 123 is provided, at which a user can firmly hold and operate the mating connector 204.

Figures 3, 4, 5, 6, 7, 8, 9, 10:
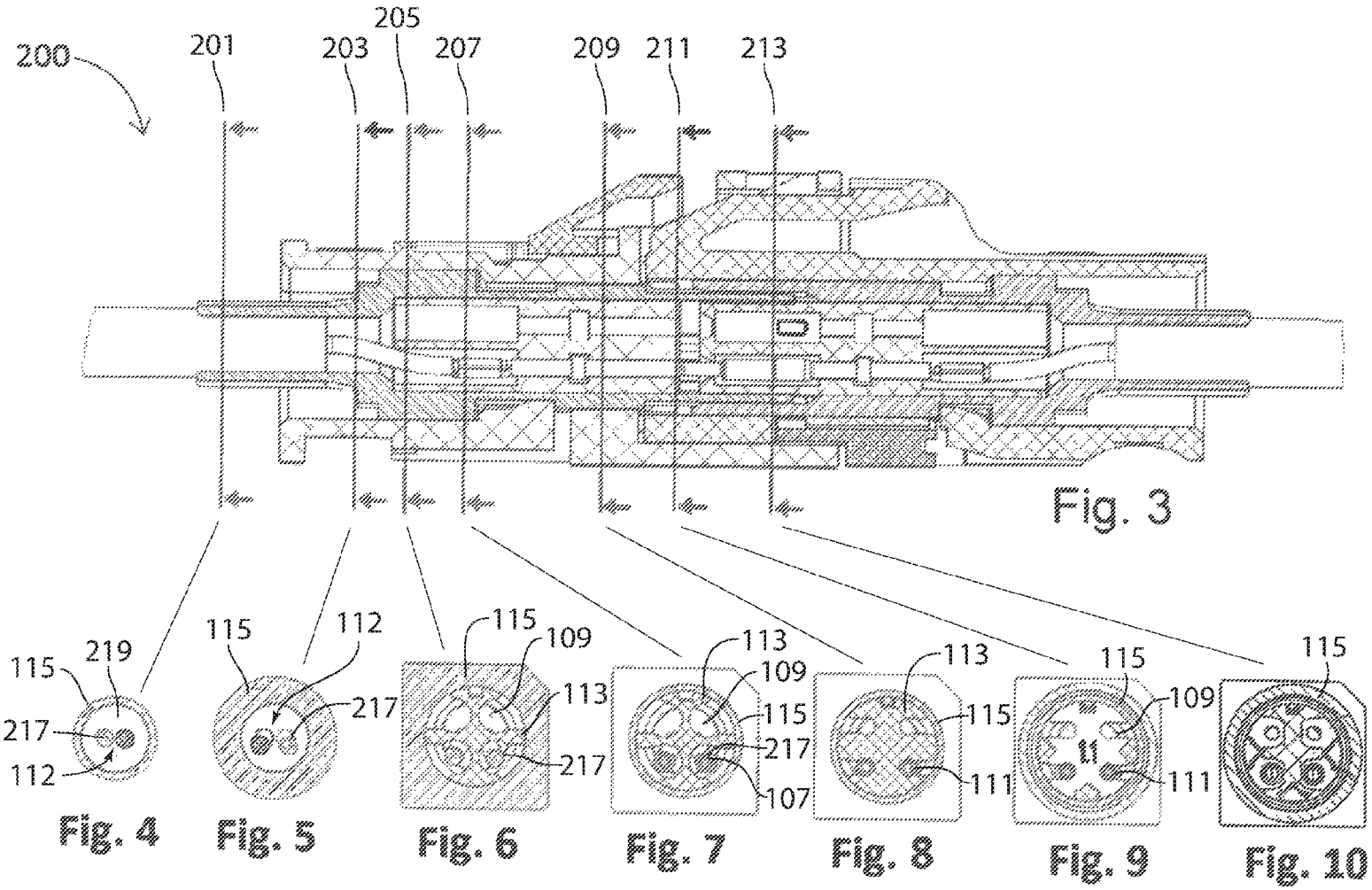
FIG. 3 shows a schematic longitudinal sectional view of one embodiment of a connector assembly according to the present disclosure.
FIG. 4 shows a schematic cross-sectional view of one embodiment of a connector arrangement according to the present disclosure.
FIG. 5 shows a schematic cross-sectional view of one embodiment of a connector arrangement according to the present disclosure.
FIG. 6 shows a schematic cross-sectional view of one embodiment of a connector arrangement according to the present disclosure.
FIG. 7 shows a schematic cross-sectional view of one embodiment of a connector arrangement according to the present disclosure.
FIG. 8 shows a schematic cross-sectional view of one embodiment of a connector arrangement according to the present disclosure.
FIG. 9 shows a schematic cross-sectional view of one embodiment of a connector arrangement according to the present disclosure.
FIG. 10 shows a schematic cross-sectional view of one embodiment of a connector arrangement according to the present disclosure.

FIG. 3 shows a connector in accordance with FIG. 2, with sections 201, 203, 205, 207, 209, 211, 213 and 214 being identified.

The cross section 201 is illustrated in FIG. 4. The region 133 is encompassed by the external conductor 115 of the connector 202. The cable 105 comprises the conductor pair 112 having cores 217. The cores 217 are surrounded by an insulation 219.

The cross section 203 is illustrated in FIG. 5. The section 203 shows the cable 105 in the intermediate portion 131, in which the distance between the cores 217 increases. The external conductor 115 compensates for the sudden change in impedance on account of the change in distance between the cores 217.

The cross section 205 is illustrated in FIG. 6. The section 205 shows an end region of the intermediate portion 131, in which the cores 217 are guided by an insulating part 113 of the connector 202. As such, insulating part 113 may be designated as a guide. It is evident that the insulating part 113 forms four chambers 109. In this embodiment, however, only two of the four chambers are occupied by cores 217, such that two of the four chambers of the insulating part 113 are empty.

The cross section 207 is illustrated in FIG. 7. The section 207 shows the connector arrangement 202 at the location at which the cores 217 are clamped to the electric contacts 111.

The cross section 209 is illustrated in FIG. 8. The section in FIG. 8 shows the connector 202 with the electric contacts 111, which are guided in accurately fitting chambers of the insulating part 113. The external conductor 115 is mechanically protected by a housing 125.

The cross section 211 is illustrated in FIG. 9. The section 211 shows the connector assembly 200 in an interface region. Accordingly, FIG. 9 illustrates two external conductors 115 formed concentrically with respect to one another, wherein the outer external conductor is to be assigned to the connector 204 and the inner external conductor is to be assigned to the connector 202.

The cross section 213 is illustrated in FIG. 10. The section 213 shows the electric contact in the coupler.

As depicted in FIGS. 4 and 6-10, an inner diameter of external conductor 115 at any of cross-sections 205-213 may be larger than an inner diameter of external conductor 115 at cross-section 203. As depicted in FIG. 3, an interior surface of external conductor 115 may be sloped with respect to a longitudinal axis of external conductor 115. In the embodiment of FIG. 3, such slope is provided between cross-sections 203 and 205.

The invention is not restricted to the embodiments, developments and subvariants illustrated. The invention concomitantly covers in particular all combinations of the features respectively claimed in the individual patent claims, the features respectively disclosed in the description and the features respectively illustrated in the figures of the drawing, in so far as they are technically practical.

Although the present invention has been fully described above on the basis of preferred exemplary embodiments, it is not restricted thereto, but rather modifiable in diverse ways.

The present disclosure may be summarized as disclosing, inter alia, the following Embodiments.

Embodiment 1

Connector arrangement (101; 103) comprising a connector (102; 104) and a cable (105) connected to the connector, which each comprise at least one conductor pair (111; 112) for transmitting a differential signal.

wherein the cable comprises a first portion (127) and the connector comprises a second portion (129), in which the conductor pair comprises electric contacts (111), and wherein the conductors are at a first mutual distance in the first portion and a second mutual distance in the second portion, said second mutual distance being greater than the first distance, wherein an intermediate portion (131) is formed between the first portion and the second portion, in which intermediate portion the distance between the conductors of a conductor pair increases in the direction of an interface-side end (135) of the connector.

wherein the conductor pair is guided in an unscreened cable in the first portion, and wherein the conductors are surrounded by an external conductor (115) in at least one part of the intermediate portion.

Embodiment 2

Connector arrangement according to Embodiment 1, wherein the external conductor is configured to set the impedance of the connector arrangement.

Embodiment 3

Connector arrangement according to Embodiment 1 or 2, wherein the conductors are twisted in the cable.

Embodiment 4

Connector arrangement according to any of Embodiments 1 to 3, wherein the external conductor is lengthened at the stripped region in the direction of the cable by way of a sheath.

Embodiment 5

Connector arrangement according to any of Embodiments 1 to 4, wherein the external conductor is configured to surround the conductors fully circumferentially.

Embodiment 6

Connector arrangement according to any of Embodiments 1 to 5, wherein the external conductor is formed as a paired external conductor.

Embodiment 7

Connector arrangement according to any of Embodiments 1 to 6, wherein the external conductor is formed at least in sections as a separate external conductor for the conductors of the conductor pair.

Embodiment 8

Connector arrangement according to any of Embodiments 1 to 7, wherein the external conductor comprises a conductive spacer between the conductors, said conductive spacer being configured in particular to determine the course of the conductors.

Embodiment 9

Connector arrangement according to any of Embodiments 1 to 8, wherein an impedance in the first and second portions and also in the intermediate portion is coordinated in each case with respect to the impedance in the other portions by means of the setting of the distance between the conductors and the external conductor and/or by a change in a diameter of the conductors and/or by a change in the distance between the conductors.

Embodiment 10

Connector arrangement according to any of Embodiments 1 to 9, wherein the external conductor is composed of a plurality of parts and the plurality of parts have in particular a non-planar surface profile corresponding to one another.

Embodiment 11

Connector arrangement according to any of Embodiments 1 to 10, wherein the external conductor is formed in an integral fashion and comprises one or more bushings in which one or more conductors are received.

LIST OF REFERENCE SIGNS

100 Connector assembly
101 Connector arrangement
102 Connector
103 Connector arrangement
104 Mating connector
105 Cable
107 B-crimp
109 Insulating chamber
111 Conductor pair, contact pins
112 Conductor pair
113 Insulating part
115 External conductor
117 Latching groove
119 Holding collar
121 Latching arrangement
122 Latching arrangement
123 Handle
125 Housing
127 First portion
129 Second portion
131 Intermediate portion
133 Region
135 Interface-side end
200 Connector assembly
202 Connector
204 Mating connector
201, 203, 205, 207, 209 Section
211, 213, 214 Section
115 External conductor
217 Core
219 Insulation

The invention claimed is:

1. A cable connector assembly, comprising:
an unshielded cable comprising a first conductor and a second conductor paired with said first conductor;
a first connector plugably engageable with a second connector; and
an electrically conductive shield,
said first connector comprising a first contact electrically connected to said first conductor and a second contact electrically connected to said second conductor,
a portion of said unshielded cable extending into a first portion of a lumen of said shield,
a portion of said first connector being situated in a second portion of said lumen of said shield, and
a distance between said first conductor and said second conductor in said second portion is larger than a distance between said first conductor and said second conductor in said first portion.

2. The cable connector assembly of claim 1, wherein:
an inner diameter of said second portion is larger than an inner diameter of said first portion.

3. The cable connector assembly of claim 1, wherein:
a portion of said lumen intermediate said first portion and said second portion is defined by an interior surface that is sloped with respect to a longitudinal axis of said shield.

4. The cable connector assembly of claim 1, wherein:
said first contact is plugably engageable with a first counterpart contact of said second connector to establish mechanical and electrical contact between said first contact and said first counterpart contact,
said second contact is plugably engageable with a second counterpart contact of said second connector to establish mechanical and electrical contact between said second contact and said second counterpart contact.

5. The cable connector assembly of claim 1, wherein:
said second conductor is paired with said first conductor in a manner suitable for communicating a differential signal.

6. The cable connector assembly of claim 1, wherein:
said second conductor is paired with said first conductor as a twisted pair.

7. The cable connector assembly of claim 1, comprising:
a guide that defines a position of at least one of said first conductor, said second conductor, said first contact and said second contact in said shield.

8. The cable connector assembly of claim 1, wherein:
said electrically conductive shield has a generally tubular shape.

9. The cable connector assembly of claim 1, wherein:
said electrically conductive shield consists of a single piece of material.

10. A cable connector assembly, comprising:
a first unshielded cable comprising a first conductor and a second conductor paired with said first conductor;
a second unshielded cable comprising a third conductor and a fourth conductor paired with said third conductor;
a first connector;
a second connector plugably engageable with said first connector;
a first electrically conductive shield that shields said first connector and a portion of said first unshielded cable; and
a second electrically conductive shield that shields said second connector and a portion of said second unshielded cable,
a plugging engagement of said second connector with said first connector effecting engagement of said second shield with said first shield to form a unitary shield that shields an engagement region of said second connector and said first connector,
said first connector comprising a first contact electrically connected to said first conductor and a second contact electrically connected to said second conductor,
said second connector comprising a third contact electrically connected to said third conductor and a fourth contact electrically connected to said fourth conductor, a distance between said first conductor and said second conductor proximate to said first connector being larger than a distance between said first conductor and said second conductor in said portion of said first unshielded cable shielded by said first shield.

11. A cable connector assembly, comprising:

an unshielded cable comprising a first conductor and a second conductor paired with said first conductor;

a first connector plugably engageable with a second connector; and an electrically conductive shield, said first connector comprising a first contact electrically connected to said first conductor and a second contact electrically connected to said second conductor, a portion of said unshielded cable extending into a first portion of a lumen of said shield, a portion of said first connector being situated in a second portion of said lumen of said shield, a distance between said first conductor and said second conductor in said second portion is larger than a distance between said first conductor and said second conductor in said first portion, said electrically conductive shield consists of a single piece of material, said first portion has a substantially circular cross-section, said second portion has a substantially circular cross-section, and a portion of said lumen intermediate said first portion and said second portion is defined by an interior surface that is sloped with respect to a longitudinal axis of said shield.

* * * * *